US008253638B2

(12) United States Patent
Siemsen et al.

(10) Patent No.: US 8,253,638 B2
(45) Date of Patent: Aug. 28, 2012

(54) PORTABLE POP-UP DIRECTION FINDING ANTENNA

(75) Inventors: Patrick J. Siemsen, Boerne, TX (US); Robert R. King, Boerne, TX (US)

(73) Assignee: Southwest Research Institute, San Antonio, TX (US)

( * ) Notice: Subject to any disclaimer, the term of this patent is extended or adjusted under 35 U.S.C. 154(b) by 350 days.

(21) Appl. No.: 12/787,962

(22) Filed: May 26, 2010

(65) Prior Publication Data

US 2011/0291900 A1 Dec. 1, 2011

(51) Int. Cl.
*H01Q 1/00* (2006.01)

(52) U.S. Cl. ..... 343/730; 343/726; 343/915

(58) Field of Classification Search ..... 343/700 MS, 343/726, 727, 728, 730, 770, 897, 915; 29/600
See application file for complete search history.

(56) References Cited

U.S. PATENT DOCUMENTS 6,480,168 B1 11/2002 Lam
7,126,553 B1 * 10/2006 Fink et al. ..... 343/767

* cited by examiner

*Primary Examiner* — Tan Ho
(74) *Attorney, Agent, or Firm* — Chowdbury & Georgakis PC; Ann C. Livingston

(57) ABSTRACT

An easily transportable multiband antenna array. The antenna array is fabricated on a multi-sided structure, such as a four-sided cube, made from a wire frame and fabric. The multi-sided structure is constructed so that it may be folded by first folding the faces against each other, and then twisting them to form a stack of loops. The antenna elements are fabricated on the faces, and comprise at least a loop antenna around the perimeter of each face, and a bow-tie antenna attached to each face. The antenna elements are fabricated and attached so that they do not inhibit the folding of the structure.

19 Claims, 4 Drawing Sheets

PORTABLE POP-UP DIRECTION FINDING ANTENNA

TECHNICAL FIELD OF THE INVENTION

This invention relates to radio direction finding apparatus, and more particularly to antenna apparatus for use with a radio direction finding system.

BACKGROUND OF THE INVENTION

Direction finding (DF) refers to the establishment of the direction from which a received signal was transmitted. The transmission could be by radio or other form of wireless communication. A single DF receiver site can establish a line of bearing, and by combining direction information from two or more suitably spaced DF receiver sites, a transmission site may be geographically located.

The antenna function of a DF system may be implemented with an array of antenna elements, that is, a multiple of antenna elements coupled to a common source. For example, a high-frequency (2 MHz to 30 MHz) DF system might use an array of loop antennas arranged in either a linear or circular arrangement.

In general, the usefulness of an antenna system is dependent upon dimensions of the antenna elements and their arrangement. Practical constraints, such as size, may make a given antenna system useful over only a limited band of frequencies.

For this reason, a DF system may use a two or more antenna subsystems, each subsystem operational over an associated frequency band. A challenge of this type of design is providing good signal separation between subsystems.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to a DF antenna array that is lightweight, quick to set up in a given location, and small enough to fit inside a backpack or other person-portable carrier. The antenna array is fabricated as a foldable cube or other multi-faced structure. The antenna elements are fabricated out of conductive cloth material, small printed circuit board material and flexible RF cable, all either sewn or fitted into pockets directly on the sides of the multi-faced structure. The array may be easily attached to an antenna mast, using attachment rods that are also easily transportable.

Figure 1:
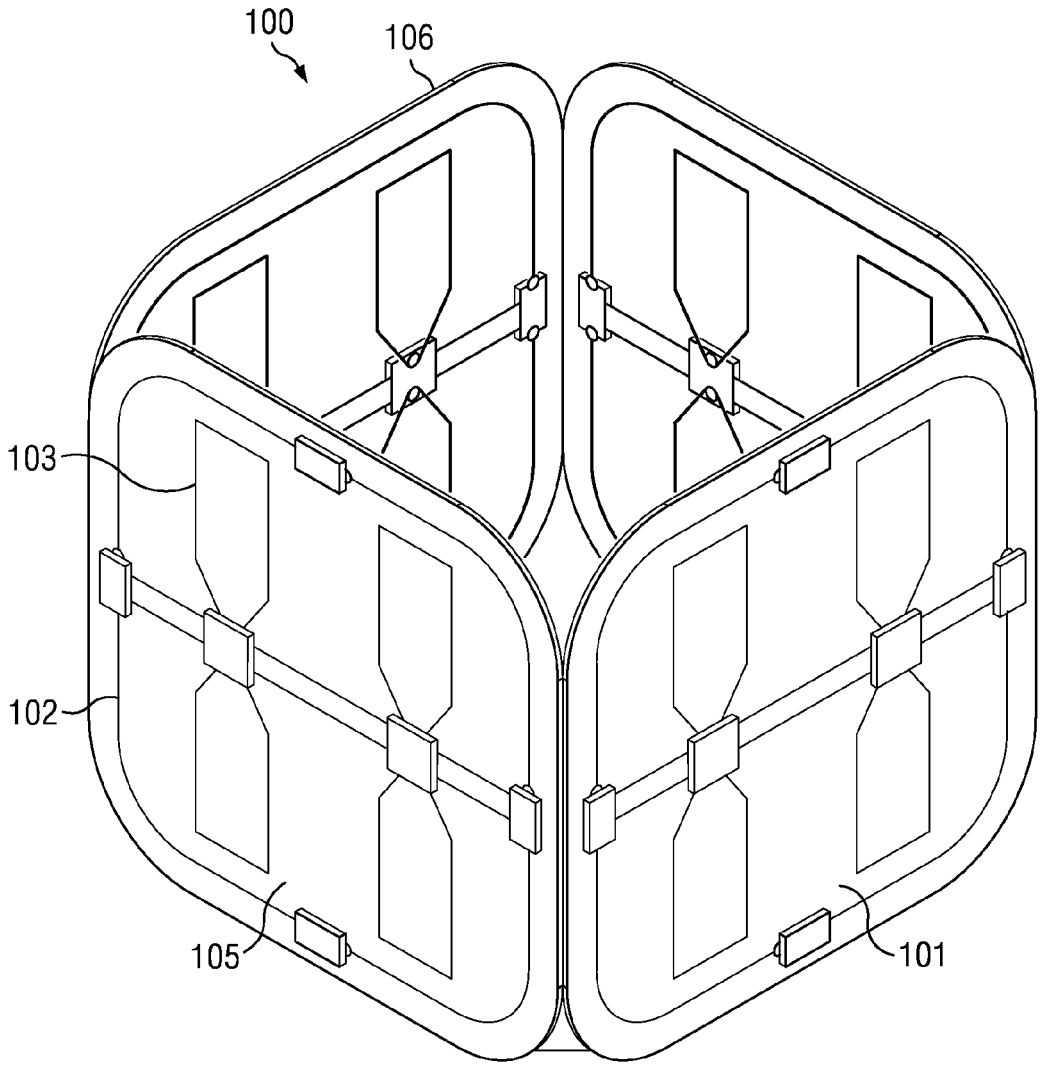
FIG. 1 illustrates an antenna array in accordance with the invention, in its deployed position.
Figure 2:
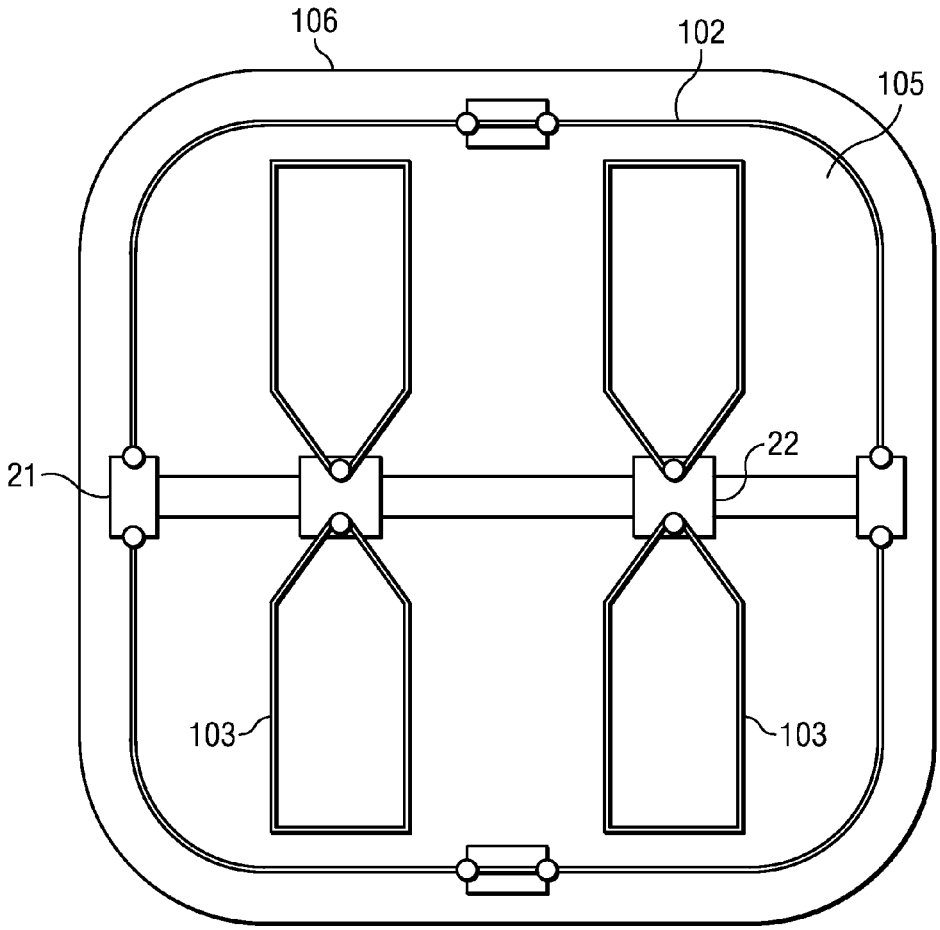
FIG. 2 illustrates a single one of the four faces of the antenna array.

FIG. 1 illustrates an antenna array 100 in accordance with the invention, in its deployed position. FIG. 2 illustrates a single one of the four faces 101 of antenna array 100. FIGS. 1 and 2 are illustrative of one embodiment of the antenna elements and associated electrical elements; a more general schematic representation is presented below as FIG. 4. Also, in the example of FIGS. 1 and 2, the multi-faced structure, upon which the antenna elements are fabricated is a cube having four faces. As explained below, however, the structure may have any number of faces greater than three.

The main structural component of array 100 is a four sided cube, that is, a cube with four faces 101 open at the top and bottom. Each face is generally rectangular in dimension, typically square. The "rectangular" dimensions need not be strictly so; the faces may be rounded and their sides may adjoin completely or partially.

Each face 101 is made out of cloth material 105 and a flexible spring-type outer frame 106 to provide shape and support. The spring steel outer frame is designed so that when untensioned, the frame comprises four rims, generally square in shape, with adjoining sides. The cloth material may be any thin flexible material or mesh that allows the cube to be folded in the manner described below. An example of a suitable material for frame 106 is flat spring steel.

As explained below, the cube is designed to be easily folded into a "coil" of smaller loops. The various antenna elements are fabricated on and/or attached to the cloth of the cube in a manner that does not inhibit its folding.

In the example of FIGS. 1 and 2, antenna array 100 is a two-band array, having a first subarray of four loop antenna elements 102 and a second subarray of eight bow-tie antenna elements 103. As explained below, in other embodiments, a three-band antenna array has a third subarray of tapered slot antenna elements.

The number of antenna elements per subarray is for purposes of example. For greater accuracy, additional elements could be used, and the eight-element subarray could use fewer elements.

Although not shown in FIG. 1, antenna array 100 is typically part of a DF system that computes a line-of-bearing to a signal of interest. The DF system uses the antenna array 100 for signal reception, a receiver to obtain two or more signals, and other hardware to make differential phase and amplitude measurements of the signals. Also not shown in FIG. 1 is the antenna mast, details of which are discussed below in connection with FIGS. 5 and 6.

Each type of antenna element (loop or bow-tie) operates over a specific portion of the frequency range of system coverage. A typical frequency range for the loop antenna subarray is 20-160 MHz. A typical frequency range for the bow-tie antenna subarray is 160-650 MHz. Thus, the configuration of FIG. 1 covers VHF and lower UHF frequencies.

Each loop antenna element 102 is made from flexible conductive cable attached around the outer perimeter of each face. Each loop antenna element 102 may be formed as a shielded loop, using coaxial cable or similar materials. Four small circuit boards 21 serve as feed points, ground connections, and/or electrical gaps for the shielded loops. Various means for attaching the loop antenna elements 102 to the cloth 105 may be used, such as by routing the antenna loop through channels sewn into the cloth or by sewing the antenna loop directly to the cloth.

The bow-tie antenna elements 103 are made using conductive cloth material attached directly onto the cloth material 105 of each face 101. Thus, the bow-tie elements are "planar" as opposed to wire-type elements. Conductive cloth is commercially available, with a particular example being a metallic coated nylon ripstop fabric. The attachment of the antenna element 103 to cloth 105 may be by sewing or any other convenient means. A small circuit board 22 provides the feed contacts for each bow-tie element. In the example of FIGS. 1 and 2, each face 101 has two bow-tie antenna elements 103, each arranged vertically on the face, but other configurations are possible.

In other embodiments, the bow-tie antenna elements 103 could be implemented as "wire" type antenna elements made from a wire type material, such as flexible cable. In this case, they could be sewn onto the material 105 or placed in cloth channels, in a manner similar to the attachment of the loop antenna elements.

All circuit boards 21 and 22 are small enough so that the array 100 can be folded as described below. They may be attached to the cloth of cube 100 by being sewed directed onto material 105 via holes around the perimeter of the circuit board. They may also be attached by being glued, sewed into pockets, or other means.

Figure 3:
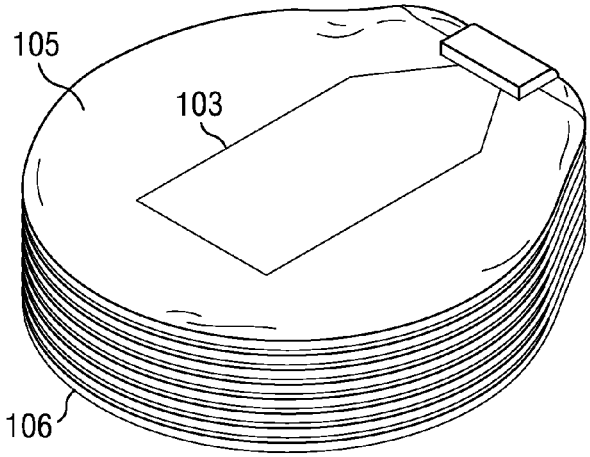
FIG. 3 illustrates the antenna array in its folded position.

FIG. 3 illustrates antenna array 100 in its folded (tensioned and coiled) position. Antenna array 100 is folded by hand, by first folding the four faces 101 against each other to form an intermediate folded piece having the width and length of one face but the thickness of four faces. Next, this intermediate folded piece is further folded by holding two opposite corners, one in each hand, and twisting in a figure-eight motion. Once twisted, the hands are brought together, and twisting results in the spring wire frame 106 forming a coil of smaller loops. As the coiled loops are pressed together, the material 105 becomes tucked between the loops.

The coiled loops can then be placed into a jacket, carrier, or other holder for storage or transport. The jacket is shaped to conform over the shape of the folded antenna array so that it does not pop out of its folded shape. Various other types of carriers and holders may be placed over or attached to the array, with the common feature being that they restrain the antenna array in its folded position.

Setting up the antenna array 100 is perhaps easier than folding it. When the folded array is removed from its holder, it pops open with its four sides stacked together. It is then manually opened up into its cubic shape.

Figure 4:
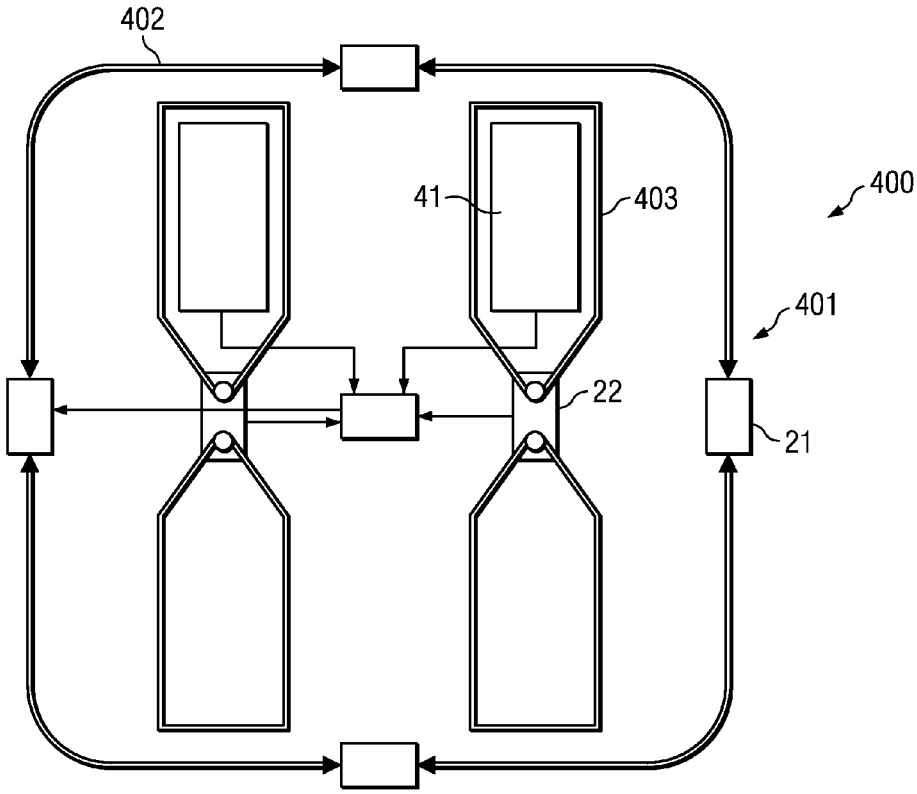
FIG. 4 illustrates how the embodiment of FIGS. 1 and 2 may be easily modified for higher frequencies by adding a third subarray of antenna elements.

FIG. 4 illustrates how the embodiment of FIGS. 1 and 2 may be easily modified for higher frequencies, and shows one face 401 of a three band array 400. In addition to a subarray of loop antenna elements 402 and a subarray of bow-tie antenna elements 403 (like those of FIGS. 1 and 2), antenna 400 has a subarray of micro-patch antenna elements 41. For purposes of this description, a "micro-patch" antenna element refers to an antenna element fabricated on a substrate using printed circuit techniques.

FIG. 4 is schematic in nature, and is intended to generally illustrate the electrical components of the three types of antenna subarrays. Various gap points and connection points may be implemented as small circuit boards as in FIGS. 1 and 2 or by other means. A small circuit board 41 may be used to provide a connection point and to connect external wiring.

In the example of FIG. 4, each micro-patch antenna is a tapered slot antenna element 41 fabricated as a small circuit board material that fits into pockets sewn onto the faces 401. In the example of FIG. 4, each face has two tapered slot elements 41, for a total of eight tapered slot elements in the subarray. A typical frequency band of the tapered slot subarray is 650-3000 MHz.

Each tapered slot antenna element comprises a printed circuit board. More specifically, tapered slot antennas are normally formed on a dielectric substrate by photolithography techniques. A metallization layer formed on one side of the substrate. A portion of the metallization layer is etched away to form a tapered slot that extends to the edge of the substrate. The antenna balun and feed line may also be fabricated on the substrate.

The placement and size of the antenna elements 41 on each face are such that they allow the array 400 to be folded as described above. In the example of FIG. 4, each tapered slot antenna element 41 is attached within a "loop" of a bow-tie antenna element 403. An example of a suitable attachment means is by being placed in a fabric pocket, but they could also be sewed onto the face of the cube via small holes in the circuit board, by being glued, or otherwise affixed to the face of the cube.

Figure 5:
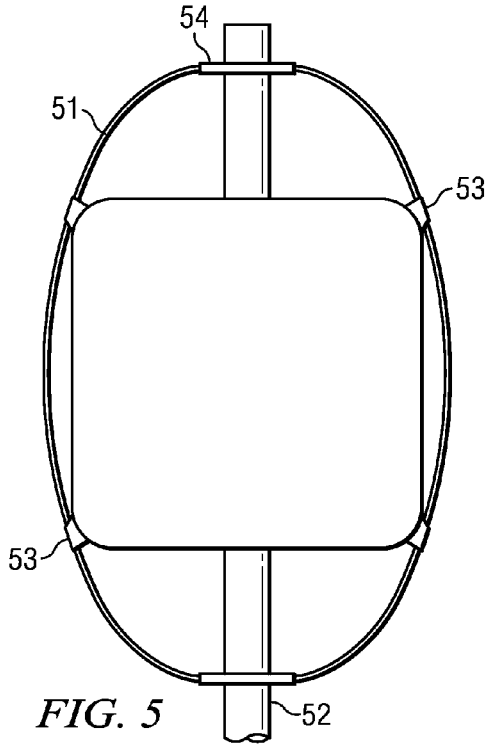
FIG. 5 illustrates how flexible rods are used to attach the antenna array to a mast.

FIG. 5 illustrates how flexible rods 51 are used to attach the antenna array 100 to a mast 52. FIG. 5 is a side view, showing one face of antenna array 100. Each corner of the antenna array 100 has a tab 53, typically made from a flexible fabric. Four flexible multi-sectioned shock-corded fiberglass rods 51 are inserted through these tabs 53. Specifically, a rod 51 is inserted through a tab 53 at the top and bottom of each corner of array 100.

Mast 52 has two brackets 54 at its top end, spaced approximately two times the height of the antenna array. The ends of the rods 51 insert into these brackets 54, above and below the antenna array 100. The mast 52 extends through the center of the antenna array. In this way, the antenna array 100 is securely attached and centered to the mast 52.

Although not explicitly shown in FIG. 5, connectors are used to attach RF cables to appropriate connection points on array 100. These cables connect to RF cables that extend out of the mast 52, completing the assembly of the DF antenna 100. The RF cables from the mast sit inside U-shaped channels (total of four) that are attached to the mast and extend out to each face 101, holding them into place. For stowage, the U-shaped channels may be folded along the side of the mast 52.

Figure 6:
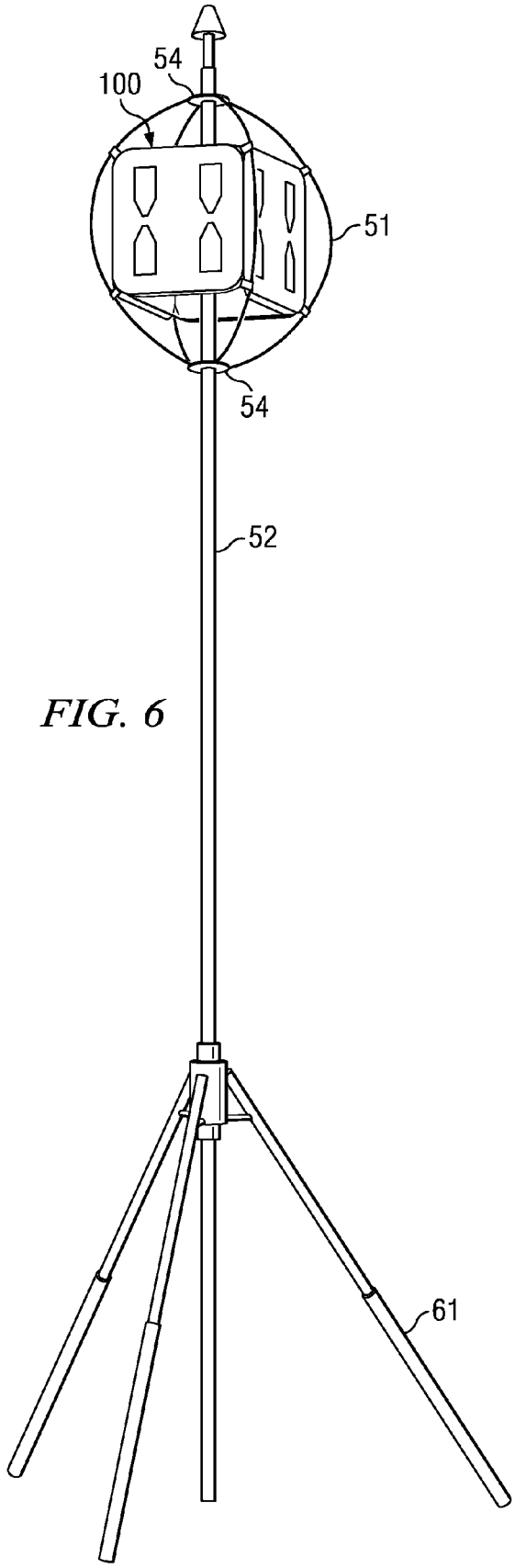
FIG. 6 illustrates a fully deployed antenna array mounted on mast having a tripod base.

FIG. 6 illustrates a fully deployed antenna array 100 mounted on mast 52. A tripod 61 provides a secure base for the mast 52. Array 100 may be easily implemented in a size as small as 20 cubic inches.

Although the preceding description has been directed to an antenna array fabricated on a four-sided cube, the same concept may be used to construct additional geometries having more or fewer faces. Regardless of the number of faces, the faces form a multi-sided structure, open at the top and bottom. Also regardless of the number of faces, each face has at least a loop and a bow-tie antenna element, to form a multi-band array, with additional antenna elements on each face being optional. The placement of the antenna elements on each face is selected for ease in folding the antenna array into a small compact shape as described above.

Structures having an even number of faces (six, eight, etc) may be folded flat and twisted into a smaller shape in a manner similar to the above-described four sided cube. Structures having an odd number of faces (three, five, etc) may incorporate a means on one side for opening the structure so that it may be folded flat. Such means could include snap fittings or a velcro strip along one side where two faces adjoin. This side is first opened, then the structure is folded flat. It may then be twisted into a smaller shape in like manner as described above.

What is claimed is:

1. A foldable antenna array, comprising:

a multi-faced structure comprised of a flexible wire frame over a cloth material, the wire frame constructed to form a number of faces in an unfolded form and to be foldable into a coil of rounded shapes;

a loop antenna attached to the cloth around the perimeter of each face, thereby forming a subarray of loop antennas; and at least one bow-tie antenna attached to the cloth of each face, thereby forming a subarray of bow-tie antennas.

2. The antenna array of claim 1, wherein each face has two bow-tie antennas.

3. The antenna array of claim 1, wherein each loop antenna is a shielded loop antenna made from coaxial cable.

4. The antenna array of claim 1, further comprising a subarray of micro-patch antenna elements, at least one micro-patch antenna element attached to each face.

5. The antenna array of claim 4, wherein the micro-patch antenna elements are tapered slot antennas.

6. The antenna array of claim 4, wherein the micro-patch antenna elements are attached within the loops of bow-tie antenna elements.

7. The antenna array of claim 1, wherein the bow-tie antenna elements are made from a conductive cloth material.

8. The antenna array of claim 1, wherein the bow-tie antenna elements are made from a wire material.

9. A method of using an antenna array for direction finding at more than one location, comprising:

acquiring signals from the array at a first location, the array being fabricated on a multi-faced structure comprised of a flexible wire frame over a cloth material, the wire frame constructed to form a number of faces in an unfolded form and to be foldable into a coil of rounded shapes; a loop antenna attached to the cloth around the perimeter of each face, thereby forming a subarray of loop antennas; and at least one bow-tie antenna attached to the cloth of each face, thereby forming a subarray of bow-tie antennas;

folding the antenna by first folding the structure into a stack of the faces, and then twisting the stack such that the wire frame twists into smaller loops;

placing the folded antenna array into, or attaching, a holder that restrains the folded antenna array in its folded position;

transporting the antenna array in its folded position; and removing the holder, thereby allowing the structure to unfold into its stack of faces;

manually opening the structure into its multi-faced shape.

10. The method of claim 9, further comprising assembling the antenna array by attaching feed wires.

11. The method of claim 9, further comprising attaching the antenna array to a mast.

12. The method of claim 11, wherein the attaching step is performed by inserting flexible rods through tabs on the structure, and by attaching the rods to brackets on the mast.

13. The method of claim 9, wherein each face has two bow-tie antennas.

14. The method of claim 9, wherein each loop antenna is a shielded loop antenna made from coaxial cable.

15. The method of claim 9, further comprising a subarray of micro-patch antenna elements, at least one micro-patch antenna element attached to each face.

16. The method of claim 15, wherein the micro-patch antenna elements are tapered slot antennas.

17. The method of claim 15, wherein the micro-patch antenna elements are attached within the loops of bow-tie antenna elements.

18. The method of claim 9, wherein the bow-tie antenna elements are made from a conductive cloth material.

19. The method of claim 9, wherein the bow-tie antenna elements are made from a wire material.

* * * * *